US005399839A

United States Patent [19]

Taplan et al.

[11] Patent Number: 5,399,839

[45] Date of Patent: Mar. 21, 1995

[54] DEVICE FOR HOLDING A BUILT-IN COOKING APPARATUS

[75] Inventors: Martin Taplan, Rheinbollen; Bernd Schultheis, Schwabenheim; Stefan Hubert, Bubenheim, all of Germany

[73] Assignee: Schott Glaswerke, Mainz, Germany

[21] Appl. No.: 285,988

[22] Filed: Aug. 4, 1994

[30] Foreign Application Priority Data

Sep. 4, 1993 [DE] Germany ..... 4329956.3

[51] Int. Cl.[6] ..... A47B 77/08; F24C 15/10; H05B 3/68

[52] U.S. Cl. ..... 219/464; 99/339; 99/349; 99/449; 126/39 B; 126/211; 219/467

[58] Field of Search ..... 99/339, 340, 449, 450; 126/39 R, 39 B, 39 H, 214 A, 211, 37 R, 300, 299 R; 219/464, 459, 463, 467; 312/236, 238, 263

[56] References Cited

U.S. PATENT DOCUMENTS

| | | | |
|---|---|---|---|
| 3,993,377 | 11/1976 | Montroy | 312/263 |
| 4,363,956 | 12/1982 | Scheidler | 219/467 |
| 4,400,045 | 8/1983 | Baschin | 312/236 |
| 4,549,052 | 10/1985 | Simon | 126/39 H |
| 4,738,243 | 4/1988 | Welsh et al. | 126/299 R |
| 4,962,694 | 10/1990 | Graver | 99/339 |
| 5,001,970 | 3/1991 | Graver | 99/450 |
| 5,162,636 | 11/1992 | Randolph, Jr. et al. | 219/464 |
| 5,317,129 | 5/1994 | Taplan et al. | 219/464 |
| 5,323,759 | 6/1994 | Hammel et al. | 126/39 B |

FOREIGN PATENT DOCUMENTS

| | | |
|---|---|---|
| 7718108 | 9/1977 | Germany . |
| 4004093 | 8/1991 | Germany . |
| 9108044 | 9/1992 | Germany . |
| 9301942 | 5/1993 | Germany . |

*Primary Examiner*—Timothy F. Simone
*Attorney, Agent, or Firm*—Michael J. Striker

[57] ABSTRACT

The device for holding a built-in cooking apparatus, especially a glass ceramic cooking apparatus, in an opening provided in a cooking apparatus receptacle (1), includes a cooking apparatus housing (2) containing heating elements; a cooking apparatus upper portion including a cooking panel (6) and a border frame (4, 5) around the cooking panel (6); a releasable clamping connection device (3, 8) for releasably attaching the cooking apparatus upper portion from above with the cooking apparatus housing; and an attachment device (3) for attaching the cooking apparatus housing (2) in the cooking apparatus receptacle (1). The attachment device (3) has an attachment device portion forming at least a part of the releasable clamping connection device (3, 8) and the cooking apparatus upper portion has an engagement device (8) for engaging the attachment device portion when the cooking apparatus upper portion is connected with the cooking apparatus housing (2), and in a simple way the engagement device is part of the releasable clamping connection device (3, 8). In another embodiment the cooking apparatus housing has a plurality of openings for tubular guide elements which act as the clamping connection device.

20 Claims, 5 Drawing Sheets

DEVICE FOR HOLDING A BUILT-IN COOKING APPARATUS

BACKGROUND OF THE INVENTION

The present invention relates to an arrangement or device for holding or mounting a built-in cooking apparatus, especially a glass ceramic cooking apparatus.

A device for holding a built-in cooking apparatus in an opening provided in a cooking apparatus receptacle is known comprising a cooking apparatus housing containing heating elements; a cooking apparatus upper portion including a cooking panel and a border frame around the cooking panel; means for releasable clamping connection of the cooking apparatus upper portion from above with the cooking apparatus housing; and attachment means for attaching the cooking apparatus housing in the cooking apparatus receptacle.

It is known that it is advantageous to form the means for connecting a built-in cooking apparatus with a cooking apparatus receptacle so that a comparatively easy required releasability is guaranteed. An arrangement is described for example in German Patent Document DE 91 08 044 U1, in which the entire built-in cooking apparatus comprises a cooking apparatus housing with the heating elements arranged therein and a cooking panel with associated frame structure attached to it and mounted on the cooking apparatus housing. In assembly this built-in cooking apparatus is inserted from above in the opening provided for it in the cooking apparatus receptacle and is secured in this position by snap- or lock-connections. Clamping springs are mounted laterally on the cooking apparatus frame, which cooperate with corresponding attachment means, such as round pegs, pointing horizontally inwardly into the opening of the cooking apparatus receptacle. To guarantee tolerance composition in regard to the attachment means, the clamping springs themselves are slidable laterally via a clamping connection on the cooking apparatus frame.

The arrangement described in German Patent Document DE 93 01 942 U1 differs from the above-described arrangement only in that the clamping springs are not arranged on the cooking apparatus frame, but instead on the wall of the opening in the cooking apparatus receptacle and the corresponding attachment means, heat lock noses or latch elements, are provided on the sides of the cooking apparatus frame and not on the cooking apparatus receptacle walls.

These known mounting arrangements have the disadvantage that either the built-in tolerances must be are very narrow, or however, as described above, comparatively expensive structures must be provided, which compensate for the dimensional variations occurring. Difficulties occur in the known cooking apparatus because the attachment of the connecting means in the cooking apparatus receptacle and the corresponding connecting means on the frame of the built-in cooking apparatus is performed at different sites so that comparatively large variations in the position of the associated connecting means relative to each other must be expected. Thus the connection means is mounted on the frame of the built-in cooking apparatus by the cooking apparatus manufacturer, while the connecting means in the cooking apparatus receptacle are provided by the kitchen builder "prior to mounting". It is further disadvantageous that the cooking apparatus must be completely removed again during servicing and subsequently disassembled.

One arrangement for mounting the built-in cooking apparatus of the type described above is taught in German Patent Document DE 77 18 108 U1 and also in German Patent Document DE 40 04 093 A1. Both cooking apparatus described in these cooking apparatus have a two part structure. The cooking apparatus housing, which acts to receive the heating elements, is securely screwed to the edge of a counter top hole as a separate structure. This work step is performed first during installation of the built-in cooking apparatus. In the next work step the glass ceramic heating panel held in a frame is placed on the cooking apparatus housing from above and secured to it. The connection between the cooking panel frame and the cooking apparatus housing is made with locking means provided on both parts which correspond with and are suitable for each other. Thus the border frame for the cooking panel has locking pins on its outer edge which engage with appropriate lock receptacles, which are rigidly connected with the cooking apparatus housing. When the cooking panel with the border frame is installed on the cooking apparatus housing the locking pins engaged in the locking receptacles whereby a downward directed force acts on the locking pins so that a reliable connection of the cooking panel with the border frame results, particularly at the sealing gasket arranged between these parts.

The above-described known apparatus has the disadvantage that the lock receptacles must be attached to the cooking apparatus housing. It is also disadvantageous that the cooking apparatus housing must also be connected by additional attachment devices with the counter top besides the comparatively complicated and expensive locking receptacles. This results in a comparatively high manufacturing and installation cost.

SUMMARY OF THE INVENTION

It is an object of the present invention to provide a device for holding a cooking apparatus of the above-described type which at least reduces or minimizes or does not have the above-described disadvantages.

It is another object of the present invention to provide a device for holding a cooking apparatus, particularly a ceramic glass cooking apparatus, of the above-described type with a two part structure so that the same effects or desirable features are obtained with comparatively simple construction means and with comparatively reduced installation effort and expense.

These objects and others which will be made more apparent hereinafter are attained in a device for holding a built-in cooking apparatus in an opening provided in a cooking apparatus receptacle comprising a cooking apparatus housing containing heating elements; a cooking apparatus upper portion including a cooking panel and a border frame around the cooking panel; means for releasable clamping connection of the cooking apparatus upper portion from above with the cooking apparatus housing; and attachment means for attaching the cooking apparatus housing in the cooking apparatus receptacle.

According to one embodiment of the present invention, the attachment means has an attachment means portion forming at least a part of the means for releasable clamping connection and the cooking apparatus upper portion has means for engaging the attachment means portion when the cooking apparatus upper portion is connected with the cooking apparatus housing. The means for engaging also forms a part of the releasable clamping connection.

The means for engaging is advantageously a plurality of two legged springs extending from the cooking apparatus upper portion and the attachment means is advantageously a plurality of screws or bolts having extended screw or bolt heads or sleeves secured to the cooking apparatus receptacle wall and positioned so that the two legged springs engage with them.

According to another embodiment of the present invention, the cooking apparatus housing is provided with a plurality of housing openings and tubular guide elements for the attachment means are mounted in each of the housing openings. The attachment means engages in the adjacent edge of the cooking apparatus receptacle through the tubular guide elements and the housing openings to hold the cooking apparatus housing in the receptacle in the counter top. The means for releasable clamping connection of the cooking apparatus upper portion from above with the cooking apparatus housing includes two legged springs connected to the cooking apparatus upper portion and distributed circumferentially around the cooking apparatus upper portion so as to be engagable with the tubular guide elements.

The holding device for the built-in cooking apparatus according to the invention is characterized by a simple a reliable construction. Because of that, the attachment means for attaching the cooking apparatus housing and/or the tubular guide elements for this attachment means on the housing are simultaneously also at least part of the clamping connection means for attachment of the cooking panel/frame structure. Thus separate clamping connection means on the cooking apparatus housing can be eliminated completely. The expense and effort involved in making the cooking apparatus housing are considerably reduced, because of the structure of the invention.

BRIEF DESCRIPTION OF THE DRAWING

The objects, features and advantages of the present invention will now be illustrated in more detail by the following detailed description, reference being made to the accompanying drawing in which.

DESCRIPTION OF THE PREFERRED EMBODIMENTS

Figure 1:
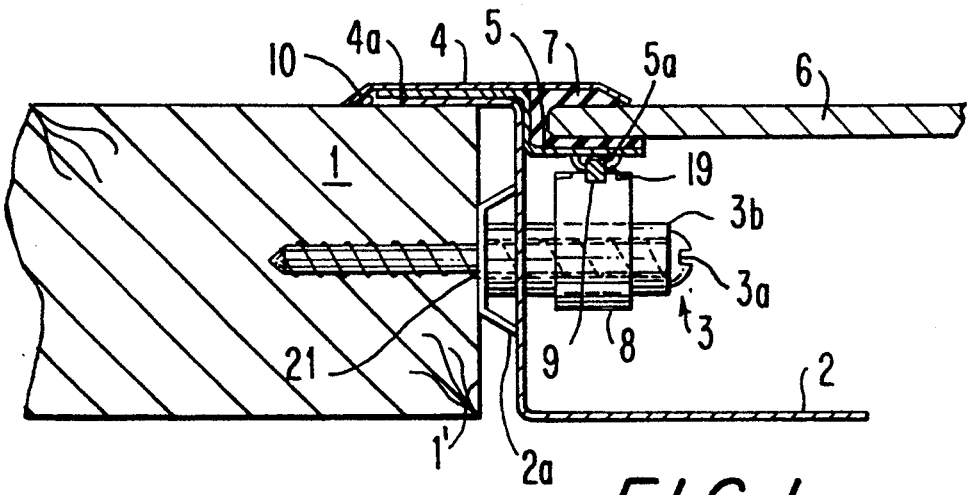
FIG. 1 is a side cross-sectional view through a preferred embodiment of the device for holding a built-in cooking apparatus according to the invention having a border frame includes a supporting frame member and a visible frame member rigidly connected to it.

A cooking apparatus receptacle 1, provided here by an opening in a counter top or panel, on whose outer edge 1' a cooking apparatus housing 2 is attached, is shown in FIG. 1. A border frame 4, 5, here comprising a supporting frame member 5 and a visible frame member 4, with a connected cooking panel 6 is mounted in the cooking apparatus housing 2. The cooking panel 6 is clamped in the border frame 4, 5 between the visible frame member 4 and the supporting frame member 5 with a temperature-resistant, permanently elastic, peripheral gasket 7, e.g. made from silicone. There is a fixed connection 4*a*, e.g. by a rivet attachment or by a point weld, between the supporting frame member 5 and the visible frame member 4 in this embodiment. A releasable connection is however also possible.

A plurality of rounded throughgoing holes 19 are sunk in the supporting frame member 5, advantageously between 10 and 12 according to the cooking apparatus size, and are distributed uniformly around the periphery of the supporting frame member 5, A leg spring 8 which is part of a clamping connection means 3, 8 is connected to the frame member 5 in each of the throughgoing holes 19 in the supporting frame member 5 by a connecting element 9, e.g. a rivet.

The cooking apparatus housing 2, which accommodates the unshown heating elements and the wiring for them, is installed in the counter top opening or receptacle 1. A spacing bracket 2*a* is provided between the peripheral edge 1' of the cooking apparatus receptacle 1, i.e. the counter top edge, and the cooking apparatus housing 2 to provide spacing between the edge of the cooking apparatus receptacle 1 and the cooking apparatus housing 2 on account of the comparatively high temperatures occurring when the cooking apparatus is operated. The spacing bracket 2*a* is provided with a throughgoing hole 21 for the purpose of attachment of the cooking apparatus housing 2 in the cooking apparatus receptacle 1. The cooking apparatus housing 2 is secured to the peripheral edge 1' of the counter top or cooking apparatus receptacle 1 with a wood screw 3*a*, on which a screw sleeve 3*b* is carried or engaged.

Figure 8A:
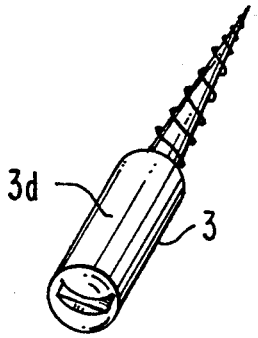
FIGS. 8*a* to 8*d* are perspective views of a corresponding peg-like element engagable with the two-legged spring shown in FIGS. 7*a* to 7*b* in the various embodiments of the holding device according to the invention which acts as part of an attachment means for releasable connection of the border frame with the cooking panel to the cooking apparatus housing.
Figure 8B:
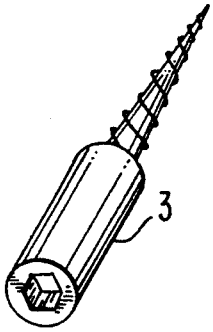

The cooking apparatus upper portion 4, 5 with the cooking panel 6 is subsequently placed in the cooking apparatus housing 2 and simultaneously pressed downwardly to secure it releasably by the clamping connection means (3, 8) in the cooking apparatus housing 2. The leg spring 8 provides a resilient connecting receptacle for the screw sleeve 3*b* of the attachment means 3 comprising wood screw 3*a* and screw sleeve 3*b* shown in FIGS. 8*a* to 8*b*, so that a releasable, tensionally connected attachment of the cooking apparatus upper portion 4, 5 with the cooking apparatus housing 2 can be made.

Because of this structure for the clamping connection means 3, 8, the cooking apparatus upper portion 4, 5 is easily installed from above in the cooking apparatus receptacle 1 in the counter top or panel. In the event that service or maintenance is necessary it is easy to disassembly or lift out the cooking apparatus upper portion 4, 5. Thus defective heating elements can be replaced in an easy and inexpensive manner. Without this type of structure according to the invention, the entire cooking apparatus must be taken out from the cooking apparatus receptacle 1. Furthermore the cooking apparatus housing 2 can have a comparatively simple structure. It is not necessary to provide additional clamping connection means in the cooking apparatus housing 2.

In the preferred embodiment of the invention shown in FIG. 1, an extended portion of the attachment means 3 formed as part of the clamping connection means extends horizontally into the interior of the cooking apparatus housing 2. The attachment means 3 could however also be formed so that this portion was located between the outer wall of the cooking apparatus housing 2 and the peripheral edge of the cooking apparatus receptacle 1. This latter embodiment is however expensive to produce.

The attachment means 3 for attaching the cooking apparatus housing 2 to the counter top edge comprises without loss of generality screws 3*a* and sleeves 3*b* which surround a portion of the screws. The sleeves 3*b* also form in a simple manner part of the clamping connection means 8, 3. In the clamping connection means 8, 3 these round peg-like elements are connected with the two legged springs 8 when the cooking panel 6 with the border frame 4, 5 is engaged with the cooking apparatus housing 2.

The invention is however in no way limited to the special type of clamping connection means of the embodiment shown in FIG. 1. However the clamping connection means 8, 3 shown in FIG. 1 is a preferred form of the clamping connection means used in general in the apparatus of the invention. Latching means and corresponding latch receiving means can also be used as the clamping connection means of the invention. Similarly it is also possible, other things being equal although also with additional effort and expense, to form the portions of the attachment means connecting the cooking apparatus housing with the counter top -edge and projecting into the cooking apparatus housing as clamping springs, e.g. two legged springs, and to bring round pegs attached to the cooking apparatus upper portion into engagement with the clamping springs to connect the upper portion of the cooking apparatus with the cooking apparatus housing. The connection possibilities are scarcely without limit.

The combination of the two legged spring and round peg-like portion of the attachment means horizontally extending into the interior of the cooking apparatus housing has the advantage that tolerances or variations in the width of the two legged spring and/or the length of the round peg part perpendicular to the peripheral edge of the cooking apparatus receptacle can be easily compensated for.

Figure 7A:
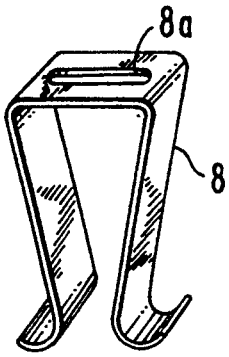
FIGS. 7*a* to 7*e* are perspective views of a two-legged spring acting as part of a clamping connection means in the above respective embodiments of the device according to the invention.

In order to compensate for structural variations or tolerances parallel to the peripheral edge 1′ of the counter top, the corresponding clamping connection means are advantageously slidable along or in the direction of the peripheral edge 1′. The structure shown in FIGS. 7*a* and 7*c* can make this possible in a simple way by providing a guide slot 8*a* in the middle portion of the two legged spring which extends parallel to the peripheral edge of the cooking apparatus receptacle 1 and by means of which the two legged spring is connected to a suitable projecting part of the cooking apparatus upper portion, specifically to the supporting frame member 5 in the embodiment of FIG. 1, so as to be slidable in the direction of the peripheral edge 1′ of the receptacle 1.

Figure 2:
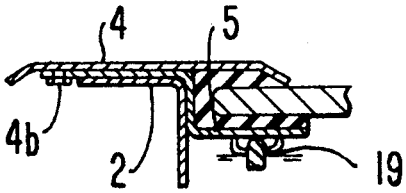
FIG. 2 is a cutaway side cross-sectional view through another embodiment of the device according to the invention, in which the visible frame member and the supporting frame member are releasably connected with each other.

Another embodiment is illustrated in part in FIG. 2. This other embodiment differs from FIG. 1 only because the fixed connection 4*a* between the visible frame member 4 and the supporting frame member 5 is replaced by a releasable connection 4*b*.

The releasable connection 4*b* can be formed by

—threaded bolts in the visible frame member 4 to which the supporting frame member 5 is attached by nuts;

—threaded throughgoing holes in the visible frame member 4 and flat-head screws securing the supporting frame member 5 to the visible frame member 4 engaged in the threaded throughgoing holes;

—bendable strap connection.

The advantage of these types of connection is that for example the cooking panel 6 can be replaced as needed in case of service prior to installation.

Figure 3:
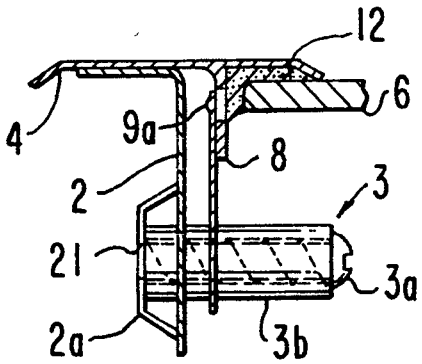
FIG. 3 is a cutaway side cross-sectional view through a further embodiment of the device according to the invention, which has a one-piece border frame.

FIG. 3 shows an additional embodiment in which the cooking panel 6 is provided with a border frame consisting of only the visible frame member 4. The cooking panel 6 is glued or connected with the visible frame member 4 in a tensional and elastic manner by adhesive means 12, e.g. silicone adhesive, distributed peripherally around the frame member 4.

Figure 7B:
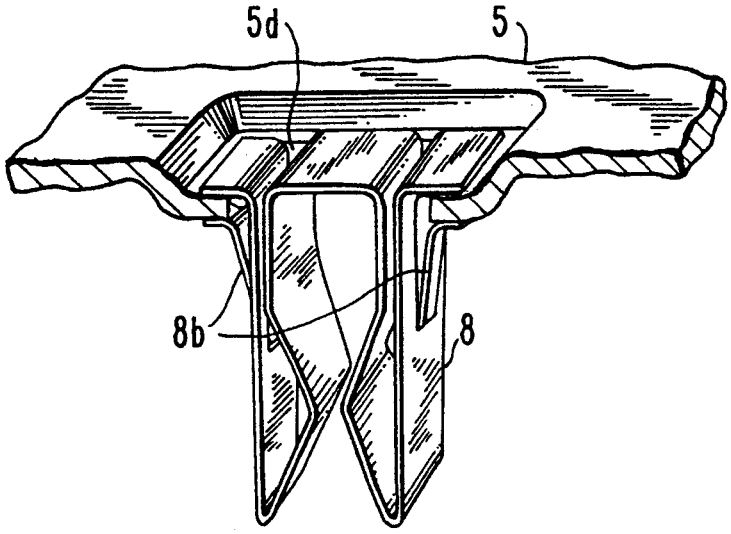
Figure 7C:
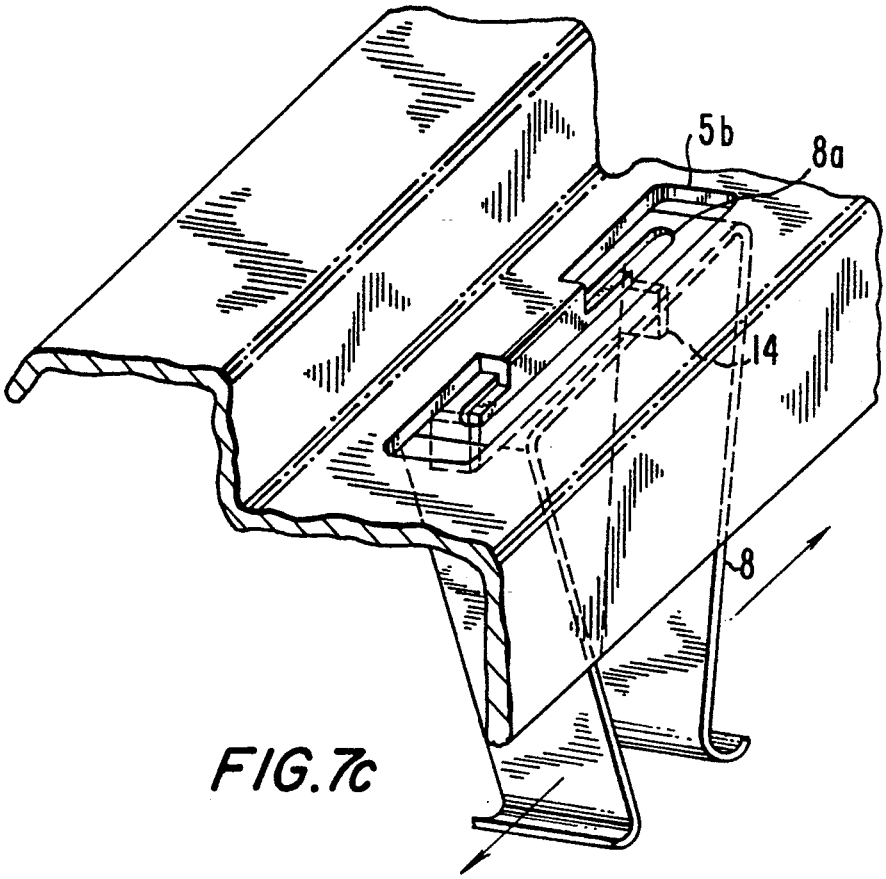
Figure 7D:
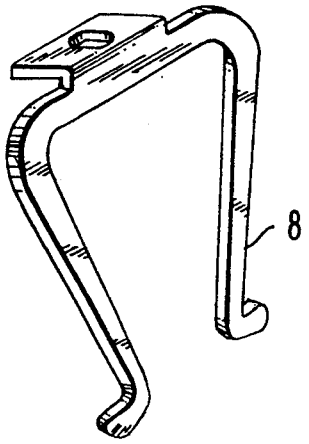
Figure 7E:
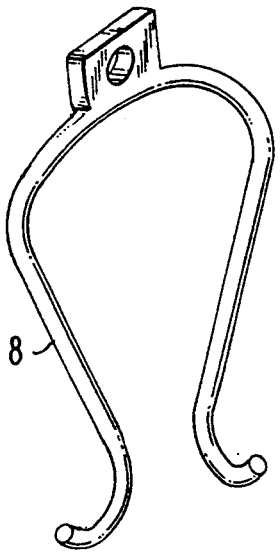

In this embodiment the clamping connection means 8 comprises flat spring elements or resilient wires, as shown in FIG. 7*d* and 7*e*, which are fixed or permanently connected with the visible frame member 4 by attaching element 9*a*. A tensional releasable connection of the spring elements or resilient wires to the attachment means 3 and/or to screws and sleeves 3*a*, 3*b* and thus to the cooking apparatus housing 2 is also made.

Figure 4:
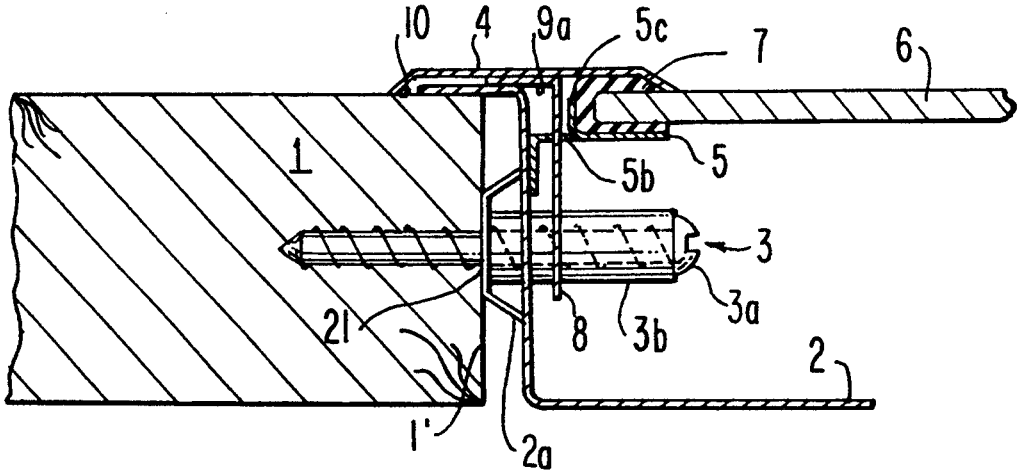
FIG. 4 is a cutaway side cross-sectional view through an additional embodiment of the device according to the invention, in which the cooking panel and the frame structure are easily disassembled and divided into their individual pieces.

FIG. 4 shows an additional embodiment of the attachment means according to the invention, in which the supporting frame member 5 is connected with the cooking apparatus housing 2 (e.g. by a point weld or by a rivet connection or by a releasable connection). After the cooking apparatus housing 2 is connected with the attachment means 3 and/or 3*a*, 3*b* in the cooking apparatus receptacle 1, the cooking panel 6, provided with a peripheral temperature resistant elastic sealing gasket 7, e.g. made of silicone, between the supporting frame member 5 and connected visible frame member 4, is plugged into the cooking apparatus receptacle 1 with the flat clamping connection means 8 uniformly distributed equally spaced around the periphery of the opening of the receptacle 1.

The spring elements 8 used in the embodiment shown in FIG. 4 are shown in FIGS. 7*d* and 7*e* and the supporting frame member 5 can be provided with slit-like punched openings 5b for engagement of the spring elements 8. The bendable vertical and punched frame member part 5c of the supporting frame member 5 acts as an aid to justifying the cooking panel on installation of the cooking panel with the sealing gasket 7. Advantageously the cooking panel-frame combination can be disassembled when service is required and also for recycling easily into its individual parts.

Figure 5:
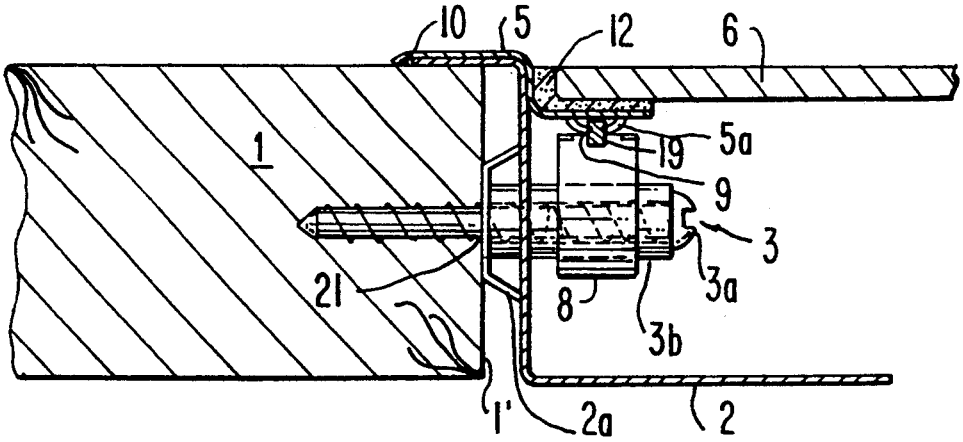
FIG. 5 is a cutaway side cross-sectional view through a further embodiment of the device according to the invention with a one-piece border frame.

FIG. 5 shows another embodiment, in which the cooking apparatus upper portion only has a supporting frame member 5. The cooking panel 6 in this case is connected tensionally and elastically with the supporting frame member by an adhesive connection 12.

Figure 6:
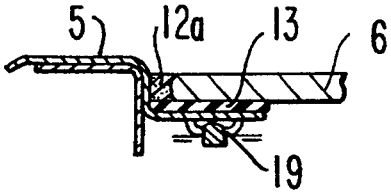
FIG. 6 is a cutaway side cross-sectional view through an additional embodiment of the device according to the invention with a special sealing device.

FIG. 6 shows another embodiment of the apparatus of the invention which differs from that shown in FIG. 5 because the cooking panel is only glued or attached by adhesive means at its extreme peripheral end edge. The cooking panel 6 sits on a permanently elastic seat 13. As already known in the structure described in German Patent Application P 43 18 854.0, the cooking surface 6 can then be easily separated from the supporting frame member 5 with a knife with scarcely any adhering adhesive for recycling.

FIG. 7b shows the detailed structure of a special embodiment of the clamping connection means part 8 and its attachment to the cooking apparatus upper portion 4, 5. The clamping connection means part 8 comprises spring elements which are clipped in the cooking apparatus upper portion, e.g. in the supporting frame member 5 or the visible frame member 4, sunk in rounded rectangular openings 5d. The restraining elements 8b arranged on the sides of the clamping connection means part or spring element 8 result in a tensional connection, however—in a somewhat oversized opening 5d—a still slightly flexible connection to the border frame.

FIG. 7c shows an additional way of attaching the clamping connection means part or spring element to the border frame. During construction of the frame in the vicinity of the bearing surfaces for the cooking panel 6 rounded slot-like openings 5b are punched out so that, as shown in FIG. 7c, a punched strap 14 is remains. This punched strap 14 is bent perpendicularly downward and the clamping connection means part 8 is subsequently attached to it via its guide slot 8a (see FIG. 7a). By bending both ends of the punched strap 14 the spring element forming the clamping connection means part 8 is secured so that it is freely movable along the frame and to such an extent that it can compensate for mounting tolerances.

Figure 8C:
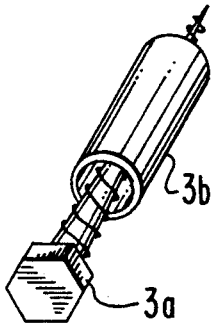
Figure 8D:
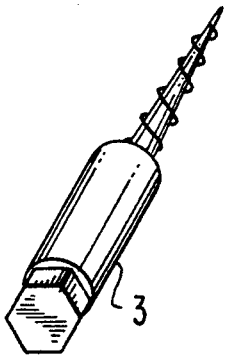

FIGS. 8a to 8d show different forms of the peg-like attachment means 3, e.g. in the form of a one-piece threaded bolt for the slot bolt screw driver (FIG. 8a) or Phillips screw driver (not shown), for a wrench for socket head cap screws(FIG. 8b) or for a socket wrench (FIG. 8d). FIG. 8c shows the attachment means 3 in the form of a simple wood screw 3a with a sleeve 3b.

Figure 9:
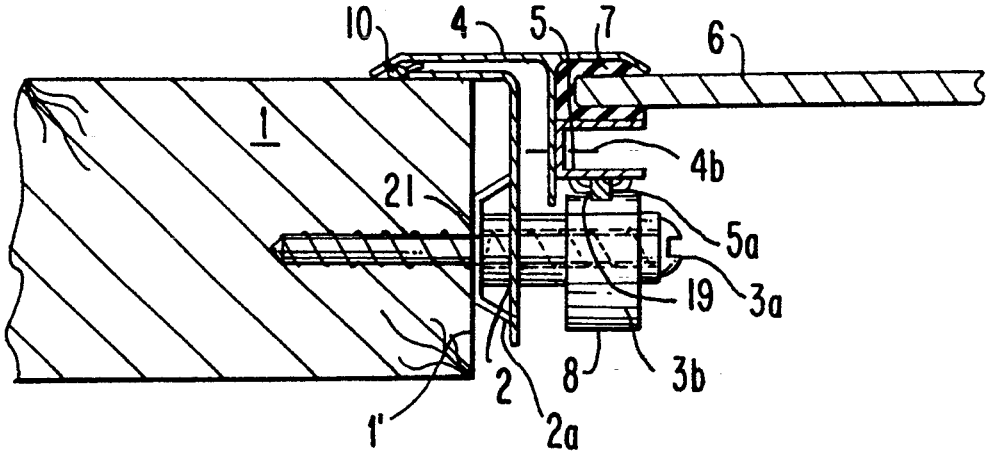
FIG. 9 is a side cross-sectional view through an embodiment of the device according to the invention similar to FIG. 2, but with a U-shaped supporting frame member.

FIG. 9 is an alternative embodiment of the invention, in which the supporting frame member 5 has a U-shaped transverse cross section and is releasably connected with the visible frame member 4 overlapping the visible frame member 4 by connecting elements 4b. The cooking panel 6 is thus clamped with the U-shaped sealing member 7 between the visible frame member 4 and the supporting frame member 5, which is installed on the edge of the cooking panel 6 (see also FIG. 2).

The releasable connecting elements 4b are thus for example:

drive screws made of iron, plastic clips(similar to those used in the automobile industry), V-shaped curved spring plates with locking grooves, plastic shims, with which the supporting frame member 5 is pushed upward and thus the cooking panel with the sealing gasket is pressed from below onto the visible frame member 4.

Figure 10:
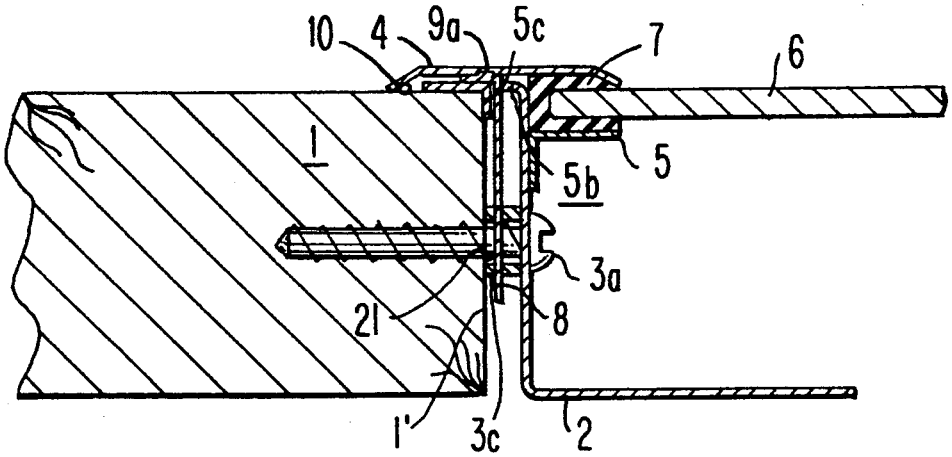
FIG. 10 is a side cross-sectional view through an embodiment of the device according to the invention, in which the clamping connection means suitable as a clamping means in the cooking apparatus upper portion are formed by tubular guide elements for the attachment means connecting the border frame to the cooking apparatus housing.

Another embodiment of the device for holding a built-in cooking apparatus is shown in FIG. 10. In this mounting arrangement throughgoing openings 23 are provided in the cooking apparatus housing 2 through which the attachment means 3 for attaching the cooking apparatus housing 2 to the peripheral edge 1' of the cooking apparatus receptacle 1 engage with the tubular guide elements 3c. The attachment means 3 can be any of the above-described attachment means shown in FIG. 8. The tubular guide elements 3c and not the attachment means 3a, 3b provide the clamping connection means part corresponding to the clamping connection means part, e.g. the screw sleeve 3b of FIG. 1, on the cooking apparatus upper portion in the previous embodiments. The tubular guide elements 3c are engaged with the two legged springs 8 mounted on the cooking apparatus upper portion to make the clamping connection as shown in FIG. 10.

The tubular guide elements 3c can be arranged on the side of the cooking apparatus housing 2 facing inward, but they can also be mounted outside on the side of the cooking apparatus housing 2 facing the edge 1' of the cooking apparatus receptacle 1 as illustrated in FIG. 10. This latter arrangement has the advantage that the tubular guide elements 3c can act simultaneously as spacing device between the cooking apparatus housing 2 and the cooking apparatus receptacle 1 . Thus they replace the punched out spacing bracket 2a shown in the embodiment in FIGS. 1, 3, 4, 5 and 9.

The tubular guide elements 3c can be attached to the cooking apparatus housing 2 in any arbitrary manner, they can for example be welded for the sake of simplicity.

As in the case of attachment means formed as part of the clamping connection means also in the case of the attachment means with the tubular guide elements acting as corresponding part of the clamping connection means, the clamping connection means can be arranged slidable relative to each other along the lateral edges of the cooking apparatus housing and/or the cooking apparatus upper portion. Also in these embodiments the two legged springs are arranged so as to be slidable along the lateral edges of the cooking apparatus receptacle, advantageously by means of guide slots in the cooking apparatus upper portion.

In this holding device with the two part border frame, comprising the visible frame member 4 and the supporting frame member 5, as shown in FIG. 10, it is advantageous to attach the border frame to the cooking apparatus housing (e.g. by a point weld or a rivet connection or a releasable connection) and the visible frame with the cooking panel, which has the clamping connection means, to which the cooking apparatus housing is connected (see here also FIG. 4 and associated description.

Other embodiments of the holding device are of course possible.

While the invention has been illustrated and described as embodied in a device for holding a built-in cooking apparatus, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. Device for holding a built-in cooking apparatus in an opening provided in a cooking apparatus receptacle (1), said device comprising a cooking apparatus housing (2) containing means for heating;

a cooking apparatus upper portion including a cooking panel (6) and a border frame (4, 5) around the cooking panel (6);

means (3, 8) for releasable clamping connection of the cooking apparatus upper portion from above with the cooking apparatus housing; and attachment means (3) for attaching the cooking apparatus housing (2) in the cooking apparatus receptacle (1);

wherein the attachment means (3) has an attachment means portion forming at least a part of the means (3, 8) for releasable clamping connection and the cooking apparatus upper portion has means (8) for engaging said attachment means portion when said cooking apparatus upper portion is connected with the cooking apparatus housing (2), said means for engaging forming another part of the means (3, 8) for releasable clamping connection.

2. Device as defined in claim 1, wherein the built-in cooking apparatus is a glass ceramic cooking apparatus.

3. Device as defined in claim 1, wherein the attachment means portion of the attachment means (3) protrudes into the cooking apparatus housing (2).

4. Device as defined in claim 3, wherein the attachment means comprises at least one peg-like element and said means for engaging includes at least one two legged spring (8), each of said at least one two legged springs being connectable with one of the at least one peg-like element.

5. Device as defined in claim 3, wherein the means for engaging includes a plurality of two legged springs (8) mounted on said border frame (4, 5) and distributed peripherally around an outer edge of said border frame (4, 5) and said attachment means includes a plurality of peg-like elements, each of said peg-like elements comprising extended portions extending horizontally into said cooking apparatus housing (2) and engagable with one of said two legged springs.

6. Device as defined in claim 5, wherein each of said peg-like elements comprises a screw (**3*a*) having an elongated screw head (3*d*) extending in an axial direction, said screw heads (3*d*) forming said extended portions of said attachment means extending horizontally into said cooking apparatus housing (2**).

7. Device as defined in claim 5, wherein each of said peg-like elements comprises a screw (**3*a*) and a sleeve (3*b*) around said screw (3*a*), said sleeves (3*b*) forming said extended portions of said attachment means extending horizontally into said cooking apparatus housing (2**).

8. Device as defined in claim 1, wherein the means for clamping connection are displacable relative to each other along a lateral edge of the cooking apparatus receptacle (1).

9. Device as defined in claim 8, wherein each of the two legged springs is provided with a guide slot (**8*a*) and means for slidably supporting each of said two legged springs is provided in said cooking apparatus upper portion (4, 5,6) and is engaged in said guide slot (8*a***) of said two legged spring connected thereto.

10. Device as defined in claim 1, wherein said border frame comprises a visible frame member and a supporting frame member attached to the visible frame member.

11. Device as defined in claim 10, wherein the visible frame member (4) is above the supporting frame member (5) in the cooking apparatus housing (2) and is fastened to the cooking apparatus housing by the means for clamping connection.

12. Device as defined in claim 10, wherein the visible frame member (4) overlapping the cooking panel (6) and the supporting frame member (5) with the means for clamping connection are releasably connected with each other by releasable connecting elements (**4*b*) and the cooking panel (6) is clamped in the border frame (4, 5) with a sealing gasket (7**).

13. Device for holding a built-in cooking apparatus in an opening provided in a cooking apparatus receptacle (1), said device comprising a cooking apparatus housing (2) containing means for heating;

a cooking apparatus upper portion including a cooking panel (6) and a border frame (4, 5) around the cooking panel (6);

means (3, 8) for releasable clamping connection of the cooking apparatus upper portion from above with the cooking apparatus housing (2);

attachment means (3) for attaching the cooking apparatus housing (2) in the cooking apparatus receptacle (1), the cooking apparatus housing (2) being provided with a plurality of housing openings (23);

a tubular guide element (3) for the attachment means (3) mounted in each of the housing openings (23), the attachment means (3) engaging in said cooking apparatus receptacle (1) through the tubular guide elements (**3*c*) and the housing openings (23); and means (3, 8) for releasable clamping connection of the cooking apparatus upper portion from above with the cooking apparatus housing (2), said means for releasable clamping connection including a plurality of two legged springs (8) connected to the cooking apparatus upper portion and distributed circumferentially around the cooking apparatus upper portion so as to be engagable with said tubular guide elements (3*c***).

14. Device as defined in claim 13, wherein the tubular guide elements (**3*c*) extend outward from said Cooking apparatus housing (2) and said tubular guide elements (3*c*) have a length such that the tubular guide elements (3*c*) simultaneously act as spacing means for spacing the cooking apparatus housing (2) from the cooking apparatus receptacle (1**).

15. Device as defined in claim 13, wherein the means for clamping connection are displacable relative to each other along a lateral edge of the cooking apparatus receptacle (1).

16. Device as defined in claim 15, wherein each of the two legged springs is provided with a guide slot (**8*a***)

and means for slidably supporting each of said two legged springs is provided in said cooking apparatus upper portion (4, 5,6) and is engaged in said guide slot (8*a*) of said two legged spring connected thereto.

17. Device as defined in claim 13, wherein said border frame comprises a visible frame member and a supporting frame member attached to the visible frame member.

18. Device as defined in claim 17, wherein the visible frame member (4) is above the supporting frame member (5) in the cooking apparatus housing (2) and is fastened to the cooking apparatus housing by the means for clamping connection.

19. Device as defined in claim 17, wherein the visible frame member (4) overlapping the cooking panel (6) and the supporting frame member (5) with the means for clamping connection are releasably connected with each other by releasable connecting elements (4*b*) and the cooking panel (6) is clamped in the border frame (4, 5) with a sealing gasket (7).

20. Device as defined in claim 13, wherein the built-in cooking apparatus is a glass ceramic cooking apparatus.

* * * * *